US010505304B2

(12) United States Patent
Shing

(10) Patent No.: US 10,505,304 B2
(45) Date of Patent: Dec. 10, 2019

(54) MOVABLE POWER CONNECTIONS FOR POWER SUPPLIES

(71) Applicant: Astec International Limited, Kowloon (HK)

(72) Inventor: Yuk Man Shing, Kowloon (HK)

(73) Assignee: Astec International Limited, Kowloon (HK)

( * ) Notice: Subject to any disclaimer, the term of this patent is extended or adjusted under 35 U.S.C. 154(b) by 0 days.

(21) Appl. No.: 16/015,500

(22) Filed: Jun. 22, 2018

(65) Prior Publication Data

US 2018/0375240 A1 Dec. 27, 2018

Related U.S. Application Data

(60) Provisional application No. 62/524,970, filed on Jun. 26, 2017.

(51) Int. Cl.

| | |
|---|---|
| ***H01R 13/11*** | (2006.01) |
| ***H01R 12/91*** | (2011.01) |
| ***H01R 12/57*** | (2011.01) |
| ***H01R 12/62*** | (2011.01) |
| ***H01R 12/72*** | (2011.01) |

(52) U.S. Cl.

CPC ..... *H01R 13/111* (2013.01); *H01R 12/91* (2013.01); *H01R 12/57* (2013.01); *H01R 12/62* (2013.01); *H01R 12/724* (2013.01)

(58) Field of Classification Search

CPC ..... H01R 13/6315; H01R 13/631; H01R 13/111; H01R 12/91; H01R 12/57; H01R 12/62; H01R 12/724

USPC ..... 439/246–248

See application file for complete search history.

(56) References Cited

U.S. PATENT DOCUMENTS

| | | | | |
|---|---|---|---|---|
| 3,964,814 | A * | 6/1976 | Kalbitz | H01F 27/40 439/248 |
| 4,845,589 | A * | 7/1989 | Weidler | H01R 25/162 361/614 |
| 5,211,585 | A * | 5/1993 | Douty | H01R 13/64 439/248 |
| 5,306,169 | A * | 4/1994 | Fukushima | H01R 12/712 439/248 |
| 6,010,375 | A * | 1/2000 | Higuchi | H01R 11/283 439/522 |
| 6,390,828 | B1 * | 5/2002 | Yamaguchi | H01R 13/631 439/247 |
| 7,980,859 | B2 * | 7/2011 | Mizumura | H01R 13/6315 439/248 |
| 8,376,766 | B1 * | 2/2013 | Huettner | H01R 12/91 439/248 |

(Continued)

*Primary Examiner* — Gary F Paumen

(74) *Attorney, Agent, or Firm* — Harness, Dickey & Pierce, P.L.C.

(57) ABSTRACT

A power supply connection assembly includes a power connector for mating with a complementary connector, a first conductor electrically coupled to the power connector, a second conductor electrically coupled to the first conductor, and a third conductor electrically coupled to the second conductor. The second conductor is flexible, and the power connector is movable relative to the third conductor in at least one direction. Other example power supply connection assemblies and power supplies including one or more power supply connection assemblies are also disclosed.

25 Claims, 7 Drawing Sheets

(56) References Cited

U.S. PATENT DOCUMENTS

| | | | | |
|---|---|---|---|---|
| 8,585,421 | B2 * | 11/2013 | Yamaguchi | H01R 13/05 439/248 |
| 9,774,117 | B1 * | 9/2017 | Jackson | B33Y 10/00 |
| 9,837,738 | B2 * | 12/2017 | Jackson | B33Y 10/00 |
| 2014/0024266 | A1 * | 1/2014 | Kashiwada | H01R 13/6315 439/686 |
| 2015/0124377 | A1 * | 5/2015 | Weiss | H01R 13/6315 361/624 |

* cited by examiner

MOVABLE POWER CONNECTIONS FOR POWER SUPPLIES

CROSS-REFERENCE TO RELATED APPLICATION

This application claims the benefit and priority of U.S. Provisional Application No. 62/524,970 filed Jun. 26, 2017. The entire disclosure of the above application is incorporated herein by reference.

FIELD

The present disclosure relates to movable power connections for power supplies.

BACKGROUND

This section provides background information related to the present disclosure which is not necessarily prior art.

Power supplies commonly include one or more power connectors for coupling to an input power source and/or a load. These power connectors typically mate with complementary connectors for receiving and/or providing AC power and/or DC power.

SUMMARY

This section provides a general summary of the disclosure, and is not a comprehensive disclosure of its full scope or all of its features.

According to one aspect of the present disclosure, a power supply connection assembly includes a power connector for mating with a complementary connector, a first conductor electrically coupled to the power connector, a second conductor electrically coupled to the first conductor, and a third conductor electrically coupled to the second conductor. The second conductor is flexible, and the power connector is movable relative to the third conductor in at least one direction.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts and/or features throughout the several views of the drawings.

DETAILED DESCRIPTION

Figure 1:
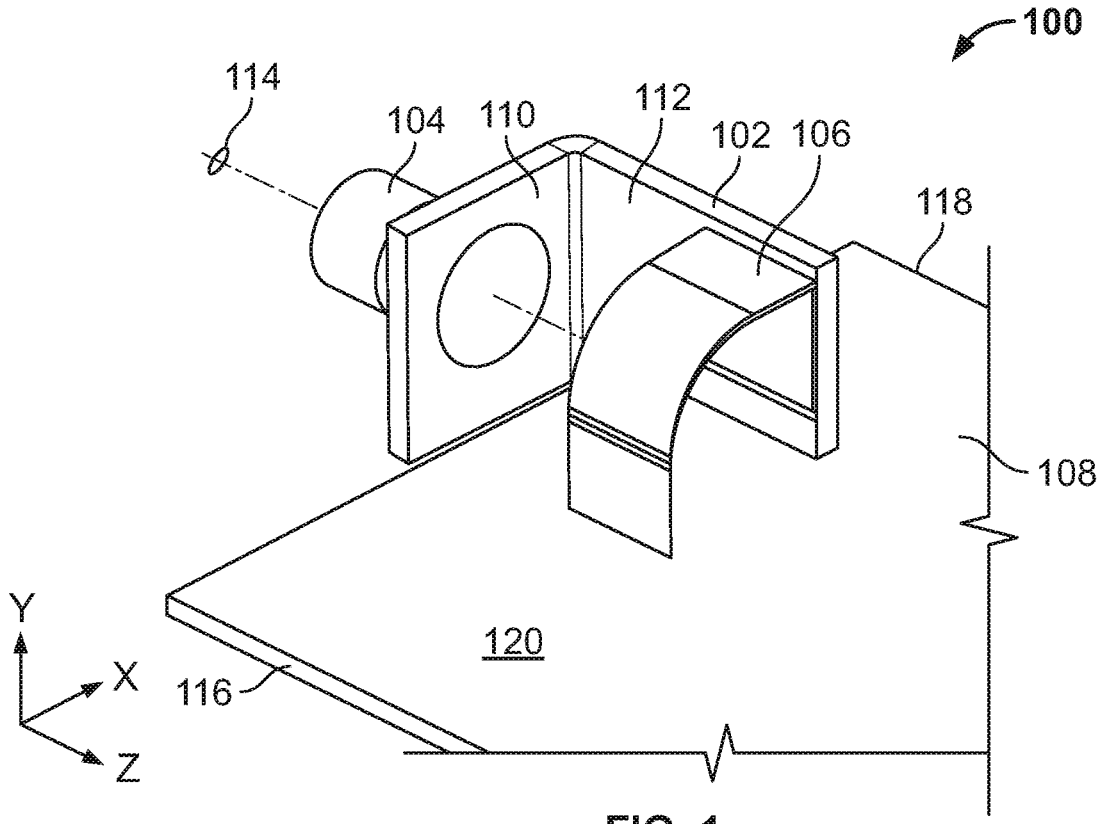
FIG. 1 is an isometric view of a power supply connection assembly including a movable power connector according to one example embodiment of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms.

These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

A power supply connection assembly for a power supply according to one example embodiment of the present disclosure is illustrated in FIG. 1 indicated generally by reference number 100. As shown in FIG. 1, the power supply connection assembly 100 includes a power connector 104 for mating with a complementary connector (not shown) and three conductors 102, 106, 108. The conductor 102 is electrically coupled to the power connector 104. The conductor 106 is electrically coupled to the conductor 102, and the conductor 108 is electrically coupled to the conductor 106. The conductor 106 is flexible, and the power connector 102 is movable relative to the conductor 108 in at least one direction.

Because the conductor 106 is flexible and the power connector 104 is movable relative to the conductor 108, a user may couple the power connector 104 to another corresponding connector with greater ease than a conventional connection assembly. For instance, the power connector 104 and the conductor 102 may be floating structures with respect to the conductor 108. This may be accomplished by not attaching the conductor 102 to the conductor 108 thereby allowing the conductor 102 to move relative to the conductor 108 in one or more directions. For example, the flexibility of the conductor 106 may allow movement of the conductor 102. As such, the power connector 104, which is electrically coupled to the conductor 102, may also float and move relative to the conductor 108 in one or more directions. Therefore, a user may couple the floating and movable power connector 104 to another corresponding connector with ease.

In the particular example of FIG. 1, the conductor 102 is a bus bar (hereinafter the "bus bar 102"), the conductor 106 is a flexible conductive strip (hereinafter the "conductive strip 106"), and the conductor 108 is a portion of a circuit board (hereinafter the "circuit board 108") such as a trace on a printed circuit board, etc. Alternatively, other suitable conductors may be employed.

In some examples, the bus bar 102 and the power connector 104 may move in multiple directions. For example, and as shown in FIG. 1, the power connector 102 has a center axis 114. The power connector 104 may be movable in a plane orthogonal to the center axis 114. For example, the power connector 104 may move in a horizontal (X) direction and/or a vertical (Y) direction in this plane orthogonal to the center axis 114.

The power connector 104 may also be movable in planes orthogonal and/or parallel to an inner surface of the circuit board 108. For example, and as shown in FIG. 1, the circuit board 108 of FIG. 1 includes opposing edge surfaces 116, 118 and an inner surface 120 extending between the opposing edge surfaces 116, 118. Because the power connector 104 and the conductor 102 are floating, the power connector 104 is able to move in a plane orthogonal to the inner surface 120 of the circuit board 108 (e.g., along the Y-axis) and/or in a plane parallel to the inner surface 120 of the circuit board 108 (e.g., along the X-axis).

Additionally, the power connector 104 may be substantially restricted from moving in a plane substantially parallel to the center axis 114. For example, in some embodiments the conductors 102, 108 may be substantially rigid and the conductive strip 106 may flex in a plane orthogonal to the center axis 114 of the power connector 104. In such examples, the power connector 104 is not movable in the axial direction (e.g., along its center axis 114).

As shown in FIG. 1, the bus bar 102 is substantially "L" shaped. Specifically, the bus bar 102 includes two planar segments 110, 112 substantially perpendicular to each other. The planar segment 110 is electrically coupled to the power connector 104, and the planar segment 112 is electrically coupled to the flexible conductive strip 106. As such, current may flow between the circuit board 108 and the power connector 104 via the flexible conductive strip 106 and the planar segments 110, 112 of the bus bar 102. In other embodiments, the bus bar 102 (and/or other bus bars disclosed herein) may have another suitable shape and/or include more or less planar or nonplanar segments.

In the example of FIG. 1, the bus bar 102, the power connector 104, and the flexible conductive strip 106 are attached (e.g., soldered) to adjacent components. For example, the flexible conductive strip 106 is attached to the planar segment 112 of the bus bar 102, and the power connector 104 is attached to the planar segment 110 of the bus bar 102. The flexible conductive strip 106 is preferably not attached to the power connector 104.

In the particular example of FIG. 1, the power connector 104 is a socket (e.g., a female connector) for receiving a corresponding pin (e.g., a male connector). In other embodiments, the power connector 104 (and/or other power connectors disclosed herein) may be a male or other suitable connector.

As shown in FIG. 1, the flexible conductive strip 106 may include a single conductive strip allowing current to flow between the circuit board 108 and the bus bar 102. This conductive strip 106 may have any suitable surface area, length, thickness, etc. depending on, for example, the desired amount of current passing through the conductive strip 106, flexibility of the conductive strip 106 (and therefore movability of the bus bar 102 and the power connector 104), etc. For example, the flexible conductive strip 106 of FIG. 1 has a rectangular shape.

In other embodiments, the flexible conductive strip 106 may include multiple conductive strips to allow current to flow between the circuit board 108 and the bus bar 102. For example, FIGS. 2A-E illustrate a power supply connection assembly 200 includes the bus bar 102, the power connector 104, and the circuit board 108 of FIG. 1, and a flexible conductor 206 having multiple flexible conductive strips. As shown in FIG. 2, the bus bar 102 is not attached to the circuit board 108 (see FIG. 2C and 2E), and the flexible conductor 206 of the power supply connection assembly 200 is not attached to the power connector 104 (see FIG. 2E). The flexible conductor 206 electrically couples the bus bar 102 to the circuit board 108. The flexible conductor 206 of FIG. 2 may function similar to the single flexible conductive strip 106 of FIG. 1.

Figure 2A:
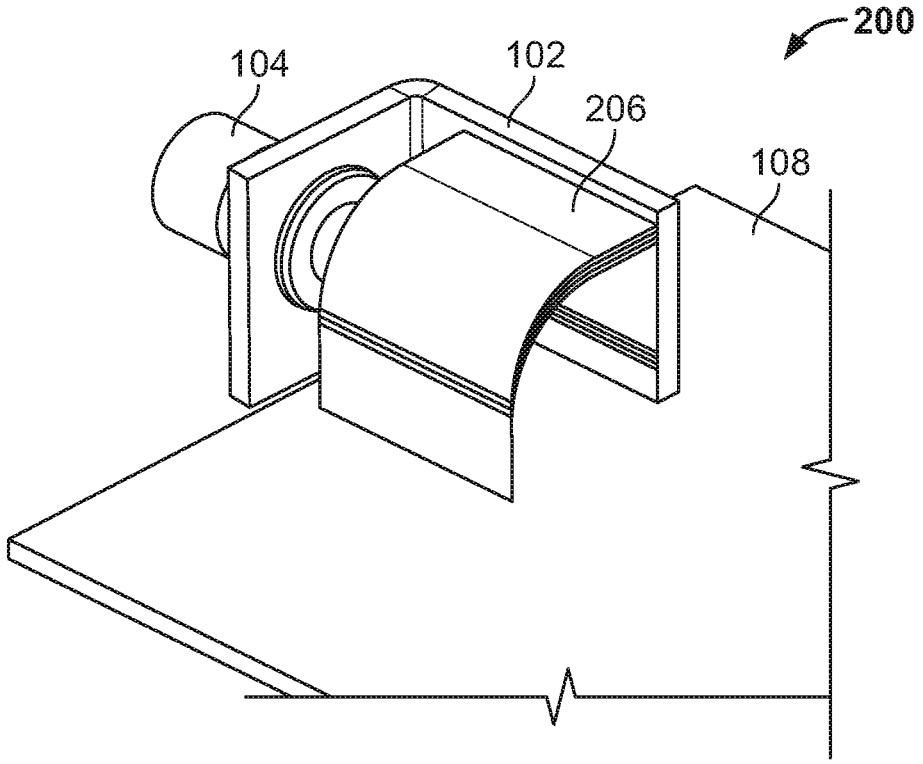
FIG. 2A is an isometric view of a power supply connection assembly including multiple flexible conductive strips according to another example embodiment.
Figure 2B:
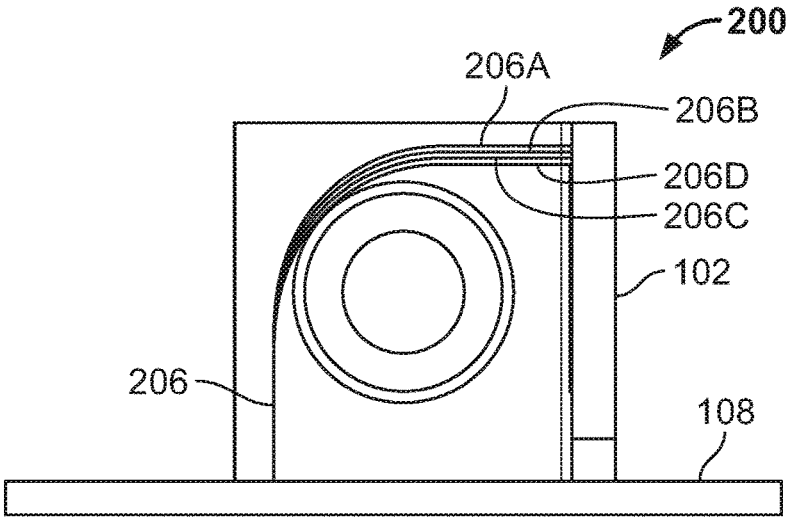
FIG. 2B is a rear view of the connection assembly of FIG. 2A.
Figure 2C:
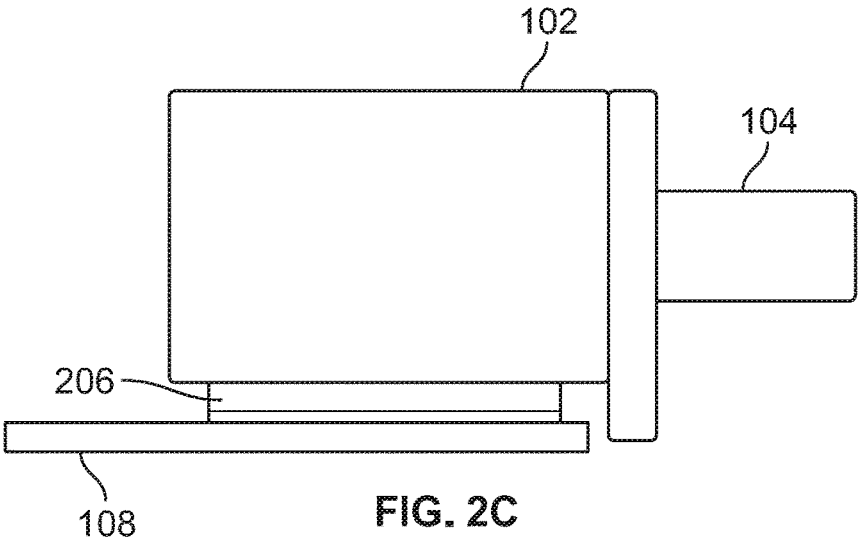
FIG. 2C is a side view of the connection assembly of FIG. 2A.
Figure 2D:
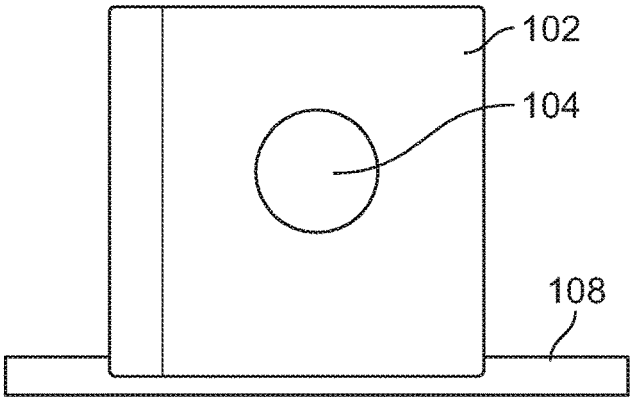
FIG. 2D is a front view of the connection assembly of FIG. 2A.
Figure 2E:
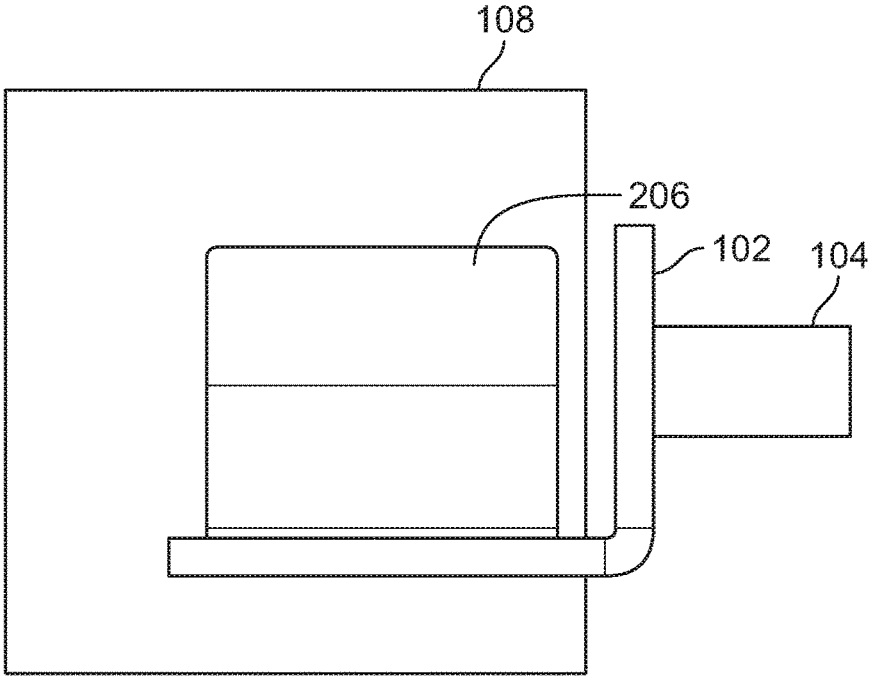
FIG. 2E is a top view of the connection assembly of FIG. 2A.

As shown in FIG. 2B, the flexible conductor 206 includes four conductive strips 206A, 206B, 206C, 206D creating four parallel current paths between the circuit board 108 and the bus bar 102. In some embodiments, the conductive strips 206A, 206B, 206C, 206D each may have a thickness less than the conductive strip 106 of FIG. 1. The conductive strips 206A, 206B, 206C, 206D collectively, however, may have similar electrical characteristics (e.g., the ability to carry a desired amount of current) as the flexible conductive strip 106 of FIG. 1.

As shown in FIGS. 2A and 2B, the conductive strips 206A, 206B, 206C, 206D are substantially unified adjacent the circuit board 108 and separated adjacent the bus bar 102. This configuration may simplify the process of attaching the flexible conductor 206 to the circuit board 108. For example, the conductive strips 206A, 206B, 206C, 206D may be joined with a single solder joint at the circuit board 108.

Figure 3:
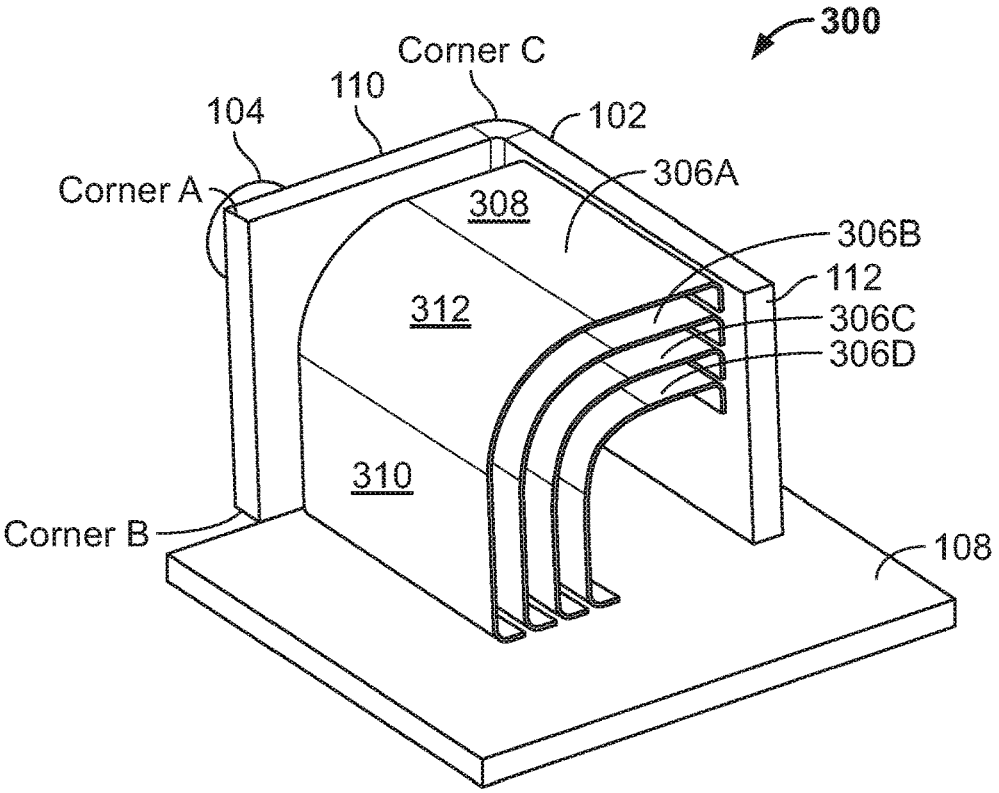
FIG. 3 is an isometric view of a power supply connection assembly including four separate flexible conductive strips according to yet another example embodiment.

FIG. 3 illustrates a power supply connection assembly 300 substantially similar to the power supply connection assemblies 100, 200 of FIGS. 1 and 2, but including a flexible conductor having multiple separated conductive strips. For example, the power supply connection assembly 300 includes the bus bar 102, the power connector 104, and the circuit board 108 of FIG. 1, and a flexible conductor 306 electrically coupling the bus bar 102 to the circuit board 108, as explained above.

As shown in FIG. 3, the flexible conductor 306 includes four flexible conductive strips 306A, 306B, 306C, 306D creating four parallel current paths between the circuit board 108 and the bus bar 102. In the example of FIG. 3, the four current paths are separated from each other. In other words, each conductive strip 306A, 306B, 306C, 306D is separately attached (e.g., soldered) to the circuit board 108 and the bus bar 102, as explained above. Alternatively, the flexible conductor 306 may include more or less separated conductive strips if desired.

As shown in FIGS. 1-3, the flexible conductors 106, 206, 306 (including their conductive strip(s)) each include a portion that is arc shaped. For example, the conductive strip(s) of FIG. 1-3 each may include two outer segments and one or more inner arc-shaped segments. For instance, the conductive strip 306A of FIG. 3 includes two outer segments 308, 310, and an inner segment 312. As shown in FIG. 3, the outer segment 308 extends in a plane substantially parallel to the circuit board 108, the outer segment 310 extends in a plane substantially perpendicular (e.g., orthogonal) to the circuit board 108, and the inner segment 312 extends between the outer segments 308, 310. In the particular example of FIG. 3, the inner segment 312 is arc-shaped. The arc-shaped inner segment 312 forms a central angle of about ninety degrees as shown in FIG. 3. In other example embodiments, the arc-shaped inner segment may have a central angle of about sixty degrees, about forty-five degrees, etc.

Figure 4:
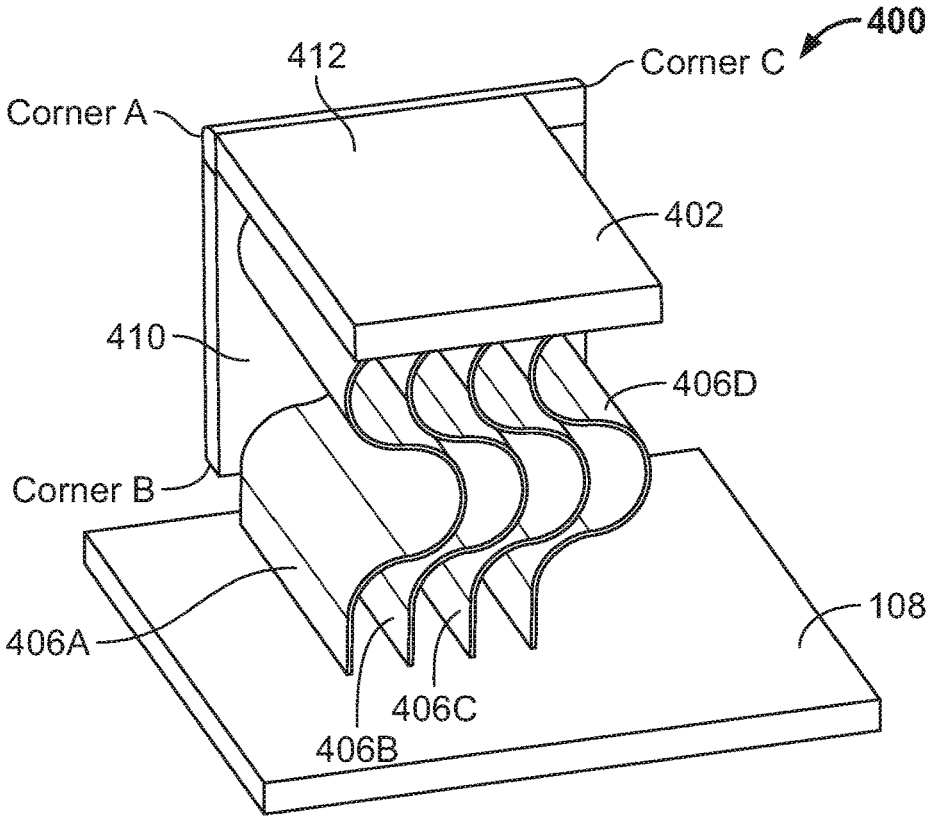
FIG. 4 is an isometric view of a power supply connection assembly including flexible conductive strips each having a wave shape according to another example embodiment.

In other embodiments, the flexible conductors 106, 206, 306 of FIGS. 1-3 may have another suitable shape. For example, FIG. 4 illustrates a power supply connection assembly 400 that functions substantially similar to the power supply connection assemblies 100, 200, 300 of FIGS. 1-3. The power supply connection assembly 400, however, includes four flexible conductive strips 406A, 406B, 406C, 406D (collectively a flexible conductor 406) each having a wave shape (also referred to as a sinusoidal shape). The flexible conductor 406 may have a lower resistive force as compared to the conductive conductors 106, 206, 306 of FIGS. 1-3.

As shown in FIG. 4, the power supply connection assembly 400 includes a bus bar 402 and the flexible conductor 406 electrically coupling the bus bar 402 to the circuit board 108 of FIG. 1. Although not shown, the power supply connection assembly 400 also includes a power connector (e.g. the power connector 104 of FIG. 1) electrically coupled to the bus bar 402. Similar to the bus bar 102, the bus bar 402 of FIG. 4 is not attached to the circuit board 108. Thus, and as explained above, the bus bar 402 and the power connector coupled to the bus bar 402 may be considered floating with respect to the circuit board 108 to allow the bus bar 402 and the power connector to move relative to the circuit board 108 in at least one direction.

Similar to the bus bar 102 of FIG. 1, the bus bar 402 of FIG. 4 includes two planar segments 410, 412 substantially perpendicular to each other. As shown, the planar segment 412 is electrically coupled to each flexible conductive strips 406A, 406B, 406C, 406D. For example, the conductive strips 406A, 406B, 406C, 406D extend between (and electrically couple) the planar segment 412 and the circuit board 108. The conductive strips 406A, 406B, 406C, 406D extend generally perpendicular relative to the circuit board 108 and the planar segment 412, and the planar segment 412 extends generally parallel to the circuit board 108. The planar segment 410 extends in a plane substantially perpendicular to the circuit board 108 and the conductive strips 406A, 406B, 406C, 406D.

Although the flexible conductor 406 includes four sinusoidal conductive strips 406A, 406B, 406C, 406D, more or less sinusoidal conductive strips may be employed including, for example, a single sinusoidal conductive strip. Additionally, the sinusoidal conductive strips may have any suitable surface area, length, thickness, etc. depending on, for example, the desired amount of current passing through the conductor 406, flexibility of the conductor 406, etc.

Figure 5:
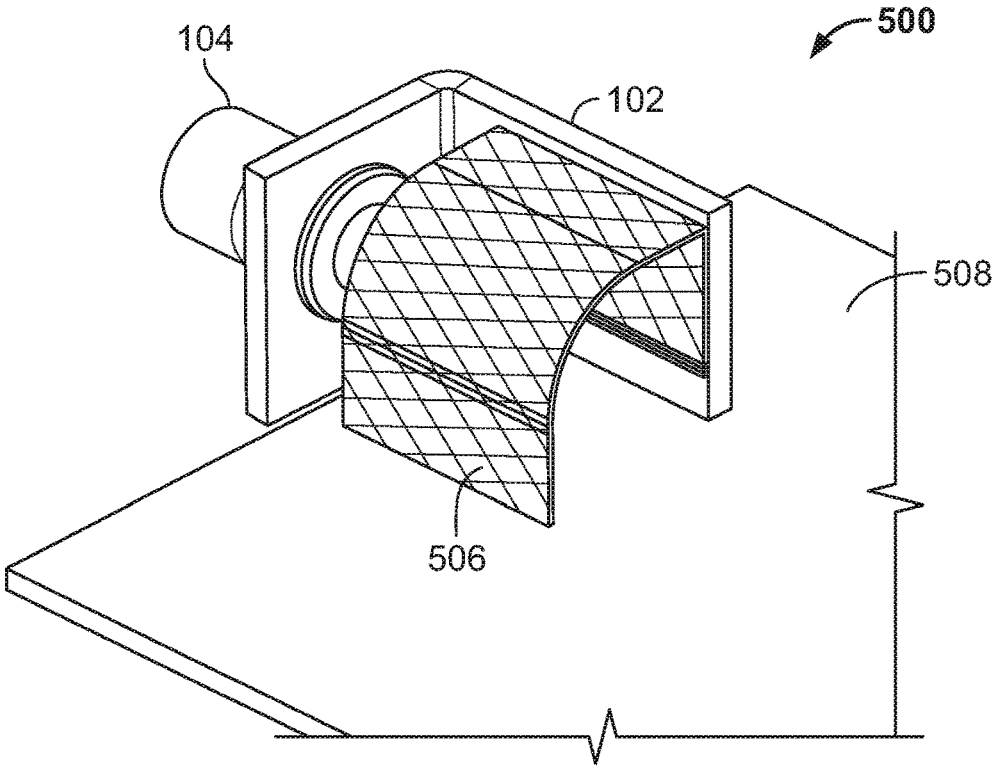
FIG. 5 is an isometric view of a power supply connection assembly including a flexible conductor formed with a braided wire according to yet another example embodiment.

FIG. 5 illustrates a power supply connection assembly 500 substantially similar to the power supply connection assembly 100 but including a different flexible conductor electrically coupling a conductor 508 and the bus bar 102 of FIG. 1. Specifically, the power supply connection assembly 500 includes a flexible conductor 506 formed of a braided wire such as a portion of the braided wire 600 shown in FIG. 6.

Figure 6:
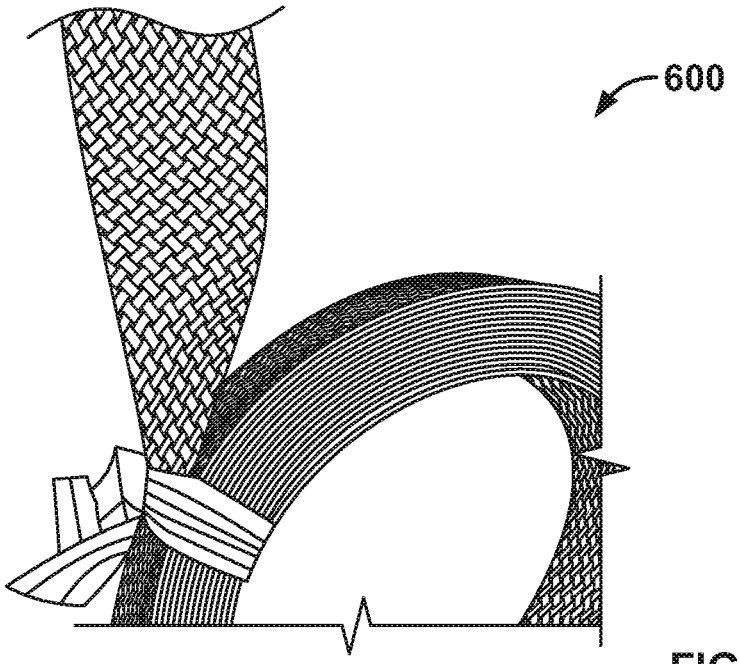
FIG. 6 is a top view of an example flexible braided wire employable in the floating power supply connection assembly of FIG. 5.

The flexible braided wire of FIGS. 5 and 6 may include copper (including one or more copper alloys) wire and/or another suitable conductive wire for passing current between the conductor 508 and the bus bar 102. The braided wire may include multiple layers of bare wire, insulated wire, and/or insulation (if desired).

The flexible conductor 506 having the braided wire functions similar to the flexible conductors 106, 206, 306 of FIGS. 1-3. In some examples, the flexible conductor 506 may provide greater flexibility (and therefore allow for greater movement of the bus bar 102 and the power connector 104) as compared to the flexible conductors 106, 206, 306 of FIGS. 1-3.

As shown in FIG. 5, the flexible conductor 506 has an arc shape similar to the flexible conductors 106, 206, 306, as explained above. In other embodiments, the flexible conductor 506 may have another suitable shape such as, for example, a substantially sinusoidal shape, etc.

In the particular example of FIG. 5, the conductor 508 is a bus bar. In other embodiments, the conductor 508 may be a portion of a circuit board such as a trace on a printed circuit board, etc.

The power supply connection assemblies disclosed herein may be used in multiple applications including, for example, server applications, data center applications, etc. For example, any one or more of the power supply connection assemblies may be connection assemblies in a power supply such as a 3 KW AC-DC power supply providing a 12V/250 A DC output. In other examples, the power supply may include a DC-DC power supply or a DC-AC power supply. In some examples, the connection assemblies may be output connection assemblies for providing output power to a load, input connection assemblies for receiving power from a source, and/or interconnection assemblies coupling two electrical components (e.g., two or more power converter modules, two or more circuit boards, etc.) together.

Figure 7:
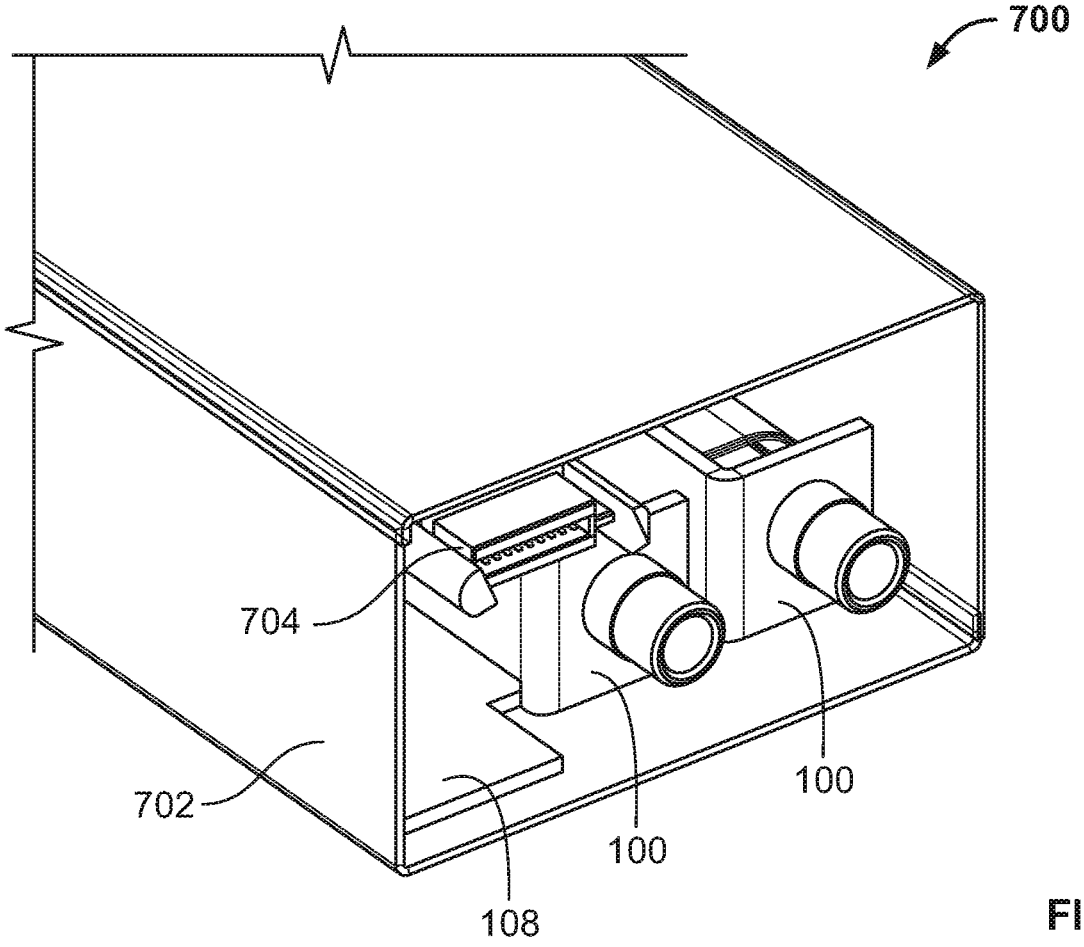
FIG. 7 is an isometric view of a power supply including two power supply connection assemblies of FIG. 1, according to another example embodiment.

For example, FIG. 7 illustrates a portion of a power supply unit 700 including a housing 702 for storing one or more electrical components (e.g., power converter modules, power switches, resistors, capacitors, inductors, circuit boards, etc.), two floating power supply connection assemblies 100 of FIG. 1, and a data connection assembly 704.

The floating connection assemblies 100 of FIG. 7 are output connection assemblies for the power supply unit 700. For example, the power supply unit 700 may be a power supply unit (e.g., AC-DC power supply unit or a DC-DC power supply unit) providing DC output power. In such examples, one of the connection assemblies 100 may be a positive output coupled to the positive output rail of the power supply unit 700 and the other connection assembly 100 may be a return output coupled to a reference potential (e.g., ground). In other embodiments, the power supply unit may provide AC output power. In such cases, the connection assemblies 100 may be a line output and a neutral output.

In the example of FIG. 7, the floating power supply connection assemblies 100 share the same circuit board 108. The circuit board 108 may be considered a main circuit board for supporting one or more of the electrical components. In other embodiments, the floating power supply connection assemblies 100 may have separate circuit boards that may or may not be used to support electrical components.

Figure 8:
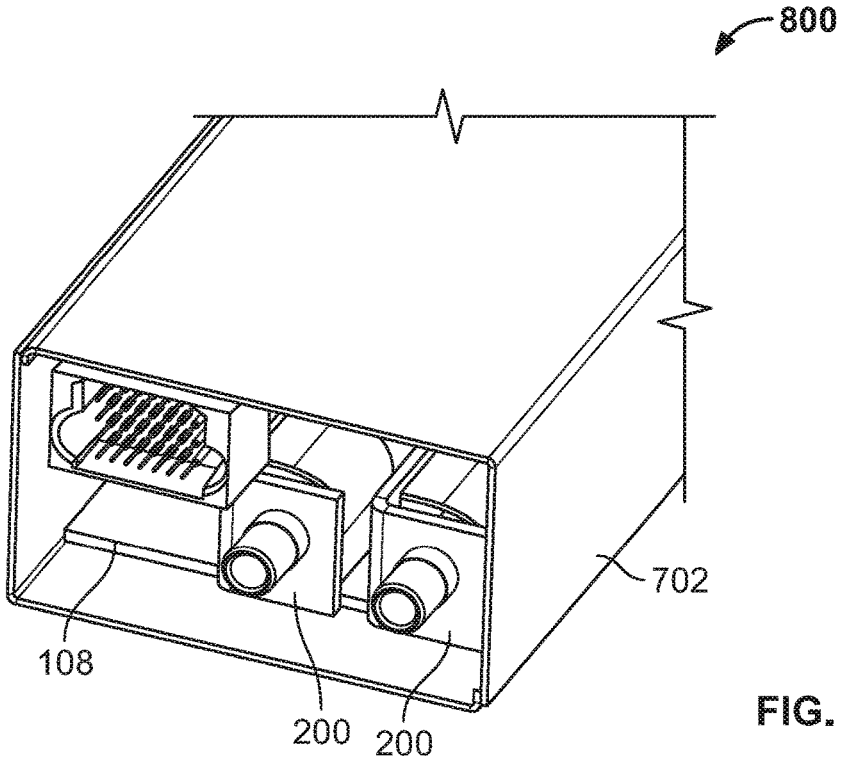
FIG. 8 is an isometric view of a power supply including two power supply connection assemblies of FIG. 2, according to yet another example embodiment.

FIG. 8 illustrates a portion of a power supply unit 800 substantially similar to the power supply unit 700, but including two connection assemblies 200 of FIG. 2. For example, the power supply unit 800 includes the housing 702 for storing one or more electrical components, the data connection assembly 704, and the circuit board 108 of FIG. 1. Similar to the connection assemblies 100 of FIG. 7, the connection assemblies 200 of FIG. 8 are output connection assemblies for providing power (e.g., DC power) to a load, and share the same circuit board 108.

Figure 9:
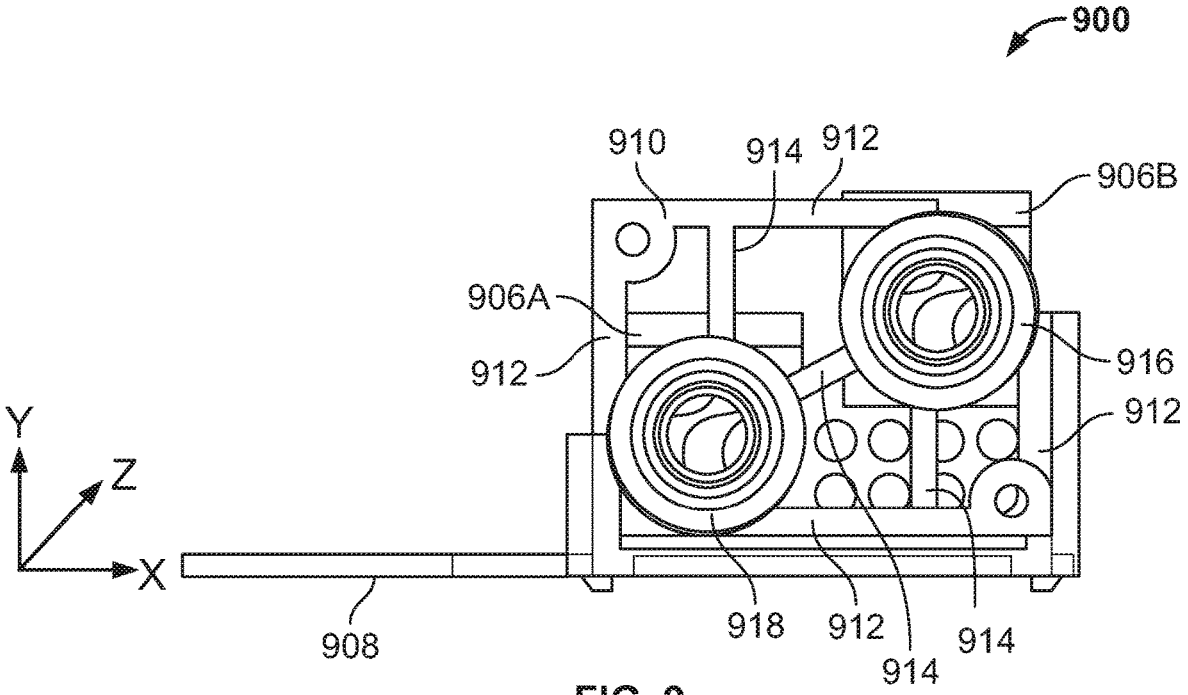
FIG. 9 is a side view of an assembly including two power supply connection assemblies and a brace according to another example embodiment.

In some examples, one or both power supply units 700, 800 may include a structure to secure the connection assemblies 100, 200. For example, FIG. 9 illustrates an assembly 900 including two power supply connection assemblies 906A, 906B and a brace 910 securing the power supply connection assemblies 906A, 906B. Each power supply connection assembly 906A, 906B may be substantially similar to any one of the power supply connection assemblies of FIGS. 1-8. For example, each power supply connection assembly 906A, 906B includes bus bars (and/or other suitable conductors), power connectors, and flexible conductors, as explained herein.

In the particular example of FIG. 9, the power supply connection assemblies 906A, 906B share a circuit board 908 (as explained above). For example, the power supply connection assemblies 906A, 906B each are attached to the circuit board 908 via the brace 910. As shown in FIG. 9, the power supply connection assemblies 906A, 906B are offset from each other relative to the circuit board 908. For example, the distance between the power connector of the power supply connection assembly 906B and the circuit board 908 is larger than the distance between the power connector of the power supply connection assembly 906A and the circuit board 908.

As shown in FIG. 9, the brace 910 (e.g., a plastic brace) includes a perimeter 912, two ring shaped supports 916, 918, and various beams 914 extending between the supports 916, 918 and/or the perimeter 912. The supports 916, 918 surround the power connectors of the power supply connection assemblies 906A, 906B, respectively. The ring shaped supports 916, 918 may secure the power connectors. For example, the ring shaped supports 916, 918 may substantially restrict movement of the power connectors in the Z direction, but allow movement (e.g., limited movement) in the X and Y directions.

Figure 10:
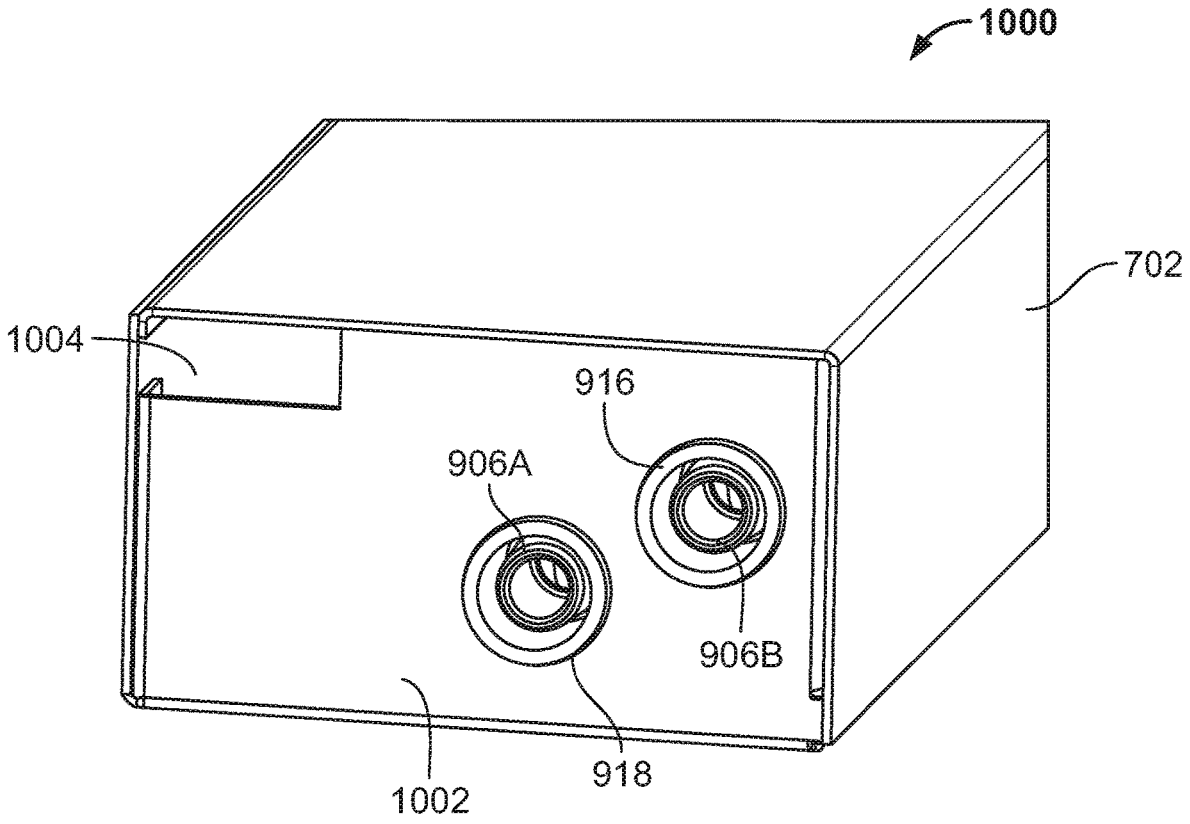
FIG. 10 is an isometric view of a power supply including the assembly of FIG. 9, according to yet another example embodiment.

FIG. 10 illustrates a portion of a power supply unit 1000 including the housing 702 of FIG. 7 having an end plate 1002 covering the brace 910 of FIG. 9. As shown, the end plate 1002 defines an opening 1004 for receiving a data connection (not shown) and openings for receiving the ring shaped supports 916, 918 and the power connectors of the connection assemblies 906A, 906B of FIG. 9.

The conductors disclosed herein (e.g., the bus bars, the flexible conductors, and/or the circuit boards) may be made of any suitable material. For example, the bus bars, the flexible conductors, and/or the circuit boards may include one or more materials having low electrical resistivity such as copper (e.g., copper alloys). In other embodiments, other suitable electrically conductive materials (e.g., aluminum including aluminum alloys) may be employed. In some embodiments, any one of the flexible conductors disclosed herein (e.g., the flexible conductor 406 of FIG. 4) may be made of a copper foil material.

The power supply connection assemblies disclosed herein may be smaller than conventional connection assemblies while still having the capability of carrying large amounts of current. For example, and with reference to FIGS. 2 and 3, the planar segment 110 of the bus bar 102 may have a length (e.g., extending from the power connector 104) of about 25 mm, the planar segment 112 of the bus bar 102 may have a length and a height of about 18 mm each, and the flexible conductor 206 may have a width of about 18 mm. As such, the power supply connection assemblies disclosed herein may be considered compact power supply connection assemblies.

Additionally, the power supply connection assemblies may have a lower reaction force as compared to conventional connection assemblies. For example, the power connectors of the power supply connection assemblies may be moved with greater ease than power connectors of conventional connection assemblies. For instance, when the power connector 104 of FIG. 3 is in its nominal position, a reaction force of about 3.8N may be required to move the power connector 104 towards one corner ("corner A") and about 2.56N may be required to move the power connector towards the opposite corner (i.e., the bottom intersecting corner of the segments 110, 112). Additionally, a reaction force of about 12.20N may be required to move the power connector toward another corner ("corner B") and about 20.59N may be required to move the power connector toward the opposite corner ("corner C"). Likewise, when the power connector 406 of FIG. 4 is in its nominal position, a reaction force of about 9.17N may be required to move the power connector toward corner A, about 12.69N may be required to move the power connector toward the opposite corner (not labeled), about 8.7N may be required to move the power connector toward corner B, and about 11.6N may be required to move the power connector toward corner C. In contrast, conventional power supply connection assemblies may require reaction forces ranging between about 45N and 55N for similar movements. As such, the reaction forces for moving the power connectors 106, 406 of FIGS. 3 and 4 are significantly lower than the reaction forces for moving power connectors in conventional power supply connection assembly designs.

Further, the power supply connection assemblies (and in particular the power connectors) may have a large position tolerance as compared to conventional designs. For example, due to the floating concept of the power supply connection assemblies, the power connectors disclosed herein may move in both the X and Y directions (as explained herein) about plus/minus 1.2 mm. This allows for greater ease in connecting complementary power connectors, as explained above.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A power supply connection assembly comprising a power connector for mating with a complementary connector, a first conductor electrically coupled to the power connector, a plurality of second conductors electrically coupled to the first conductor, and a third conductor electrically coupled to the plurality of second conductors, wherein the plurality of second conductors each are flexible and attached to the first conductor and the third conductor, wherein the first conductor extends in a plane orthogonal to the power connector, and wherein the power connector is movable relative to the third conductor in at least one direction.

2. The power supply connection assembly of claim 1 wherein the power connector has a center axis and is movable in a plane orthogonal to the center axis of the power connector.

3. The power supply connection assembly of claim 2 wherein the power connector is not movable in a plane parallel to the center axis.

4. The power supply connection assembly of claim 1 wherein the first conductor comprises a bus bar.

5. The power supply connection assembly of claim 4 wherein the bus bar is substantially "L" shaped.

6. The power supply connection assembly of claim 1 wherein the plurality of second conductors comprise at least one conductive strip.

7. The power supply connection assembly of claim 6 wherein a portion of the at least one conductive strip has a sinusoidal shape.

8. The power supply connection assembly of claim 6 wherein a portion of the at least one conductive strip is arc-shaped.

9. The power supply connection assembly of claim 1 wherein the plurality of second conductors comprise at least one braided wire.

10. The power supply connection assembly of claim 1 wherein the third conductor comprises a circuit board.

11. The power supply connection assembly of claim 1 wherein the third conductor comprises a bus bar.

12. The power supply connection assembly of claim 1 wherein the first conductor is not attached to the third conductor.

13. The power supply connection assembly of claim 1 wherein the plurality of second conductors are not attached to the power connector.

14. A power supply comprising the power supply connection assembly of claim 1.

15. The power supply of claim 14 wherein the power supply connection assembly is an output power connector.

16. The power supply connection assembly of claim 2 wherein the first conductor comprises a bus bar.

17. The power supply connection assembly of claim 16 wherein the bus bar is substantially "L" shaped.

18. The power supply connection assembly of claim 17 wherein the third conductor comprises a circuit board or a bus bar.

19. The power supply connection assembly of claim 1 wherein the plurality of second conductors are substantially unified adjacent the third conductor and separated adjacent the first conductor.

20. A power supply connection assembly comprising a power connector for mating with a complementary connector, a first conductor electrically coupled to the power connector, a second conductor electrically coupled to the first conductor, and a third conductor electrically coupled to the second conductor, wherein the power connector includes a center axis and is movable in a plane orthogonal to the center axis of the power connector, wherein the first conductor includes a substantially "L" shaped bus bar, wherein the second conductor is flexible and extends along a single continuous arc between the first conductor and the third conductor, and wherein the power connector is movable relative to the third conductor in at least one direction.

21. The power supply connection assembly of claim 20 wherein the third conductor comprises a circuit board or a bus bar.

22. A power supply comprising the power supply connection assembly of claim 20.

23. The power supply of claim 22 wherein the power supply connection assembly is an output power connector.

24. The power supply connection assembly of claim 20 wherein the second conductor comprises at least one braided wire.

25. The power supply connection assembly of claim 20 wherein the power connector is not movable in a plane parallel to the center axis, wherein the first conductor is not attached to the third conductor, or wherein the second conductor is not attached to the power connector.

* * * * *